US006383006B1

(12) United States Patent
McHugh et al.

(10) Patent No.: US 6,383,006 B1
(45) Date of Patent: May 7, 2002

(54) ZIF SOCKET HAVING LEVER RETENTION MEANS

(75) Inventors: Robert G. McHugh, Golden, CO (US); Sung-Pei Hou, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/931,085

(22) Filed: Aug. 15, 2001

(51) Int. Cl.[7] ..... H01R 4/50
(52) U.S. Cl. ..... 439/342
(58) Field of Search ..... 439/70, 342, 71

(56) References Cited

U.S. PATENT DOCUMENTS 5,167,515 A * 12/1992 Matsuoka et al. ..... 439/108
5,489,217 A * 2/1996 Scheitz et al. ..... 439/342
5,679,020 A * 10/1997 Lai et al. ..... 439/342
5,697,803 A * 12/1997 Kistner et al. ..... 439/342
5,722,848 A * 3/1998 Lai et al. ..... 439/342
5,947,778 A * 9/1999 Lai et al. ..... 439/876

* cited by examiner

*Primary Examiner*—Tulsidas Patel
(74) *Attorney, Agent, or Firm*—Wei Te Chung

(57) ABSTRACT

A ZIF socket (2) comprises a base (20) defining a bottom half channel (200) and a cover (22) defining an upper half channel (220) wherein the bottom half channel joins with the upper half channel to form a full channel enclosing a lever (24) of the socket having a cam shaft (242) and a handle (240). A retention means (205) is fixed on the rear portion of the base, a resilient arm extends forwardly from a top portion of the retention means and defines a recess (209) thereon. The recess (209) can keep the handle positioned on one side of the socket at a vertical position with regard to the base.

11 Claims, 5 Drawing Sheets

ZIF SOCKET HAVING LEVER RETENTION MEANS

BACKGROUND OF THE INVENTION

1. Field of the Invention

The present invention is generally related to a ZIF (zero insertion force) socket, and particularly to ZIF socket having a retention means formed on a base of the socket to retain effectively a lever of the socket in a vertical position with regard to the base.

2. Description of the Related Prior Art

The CPUs are more and more popular in the computer industry. As well known, the CPU is commonly connected to a mother board through a ZIF socket which is directly mountably soldered on the mother board. It is noted that the ZIF socket generally includes a base securely mounted onto the mother board, and a cover slidably moved with regard to such base by way of lever means whereby the CPU may be loaded onto the socket in a ZIF status when the lever is in a vertical position and the socket is in an open state, and the conductive pins of the CPU can engage the corresponding contacts in the socket for operative signal transmission when the lever is in a horizontal position and the socket is in a closed state. Prior art ZIF sockets are disclosed in U.S. Pat. Nos. 5,722,848, and 5,167,515. A related art is shown in FIG. 5, which discloses a ZIF socket 1 comprising a base 11, a cover 12 slidably mounted to the base 11 and a lever 13 including an actuation handle 131 and a cam shaft 132 joined with each other at an angle. The cover 12 has an upper half channel 120 and the base 11 has a bottom half channel 110 wherein the upper channel 120 joins with the bottom channel 110 to form a fall channel enclosing the cam shaft 132 therein. In assembly, the can shaft 132 is received in the bottom half channel 110 and the handle 131 is exposed to one side of the base 11. A CPU (not shown) is loaded onto the cover 12 under zero insertion force when the lever is in a vertical position. After the handle 131 is driven to a horizontal position, conductive pins of the CPU will engage with conductive means of the socket 1 and the socket 1 is in a closed state.

This type of socket includes several disadvantages. First, it is difficult to load the cover 12 onto the base 13 if the lever 13 has shifted from the vertical position a certain angle and the CPU cannot be loaded onto the socket under a zero insertion force. Secondly, the cover 12 and the base 11 will nip the pins of the CPU tightly if the handle 132 of the lever 13 so shifts from the vertical position that the cover 12 slides a distance against the base 11. Furthermore, the cam shaft 132 will push the cover 12 a certain distance from the right position in a horizontal direction for being fixed on the cover 12 straight. Therefore the CPU is difficult to be pulled out and pins of the CPU will have a tendency of being damaged.

Hence, an improved ZIF socket having retention means is required to overcome the disadvantages of the prior art.

BRIEF SUMMARY OF THE INVENTION

Therefore, an object of the present invention is to provide a ZIF socket having retention means directly formed on a base of the socket to effectively retain a lever at a right position relative to the base.

To achieve the above-mentioned object, a ZIF socket in accordance with the present invention comprises a base defining a bottom half channel and a cover defining an upper half channel wherein the bottom half channel joins with the upper half channel to form a full channel enclosing a lever of the socket having a cam shaft and a handle. A retention means is fixed on the rear portion of the base, a resilient arm extends from top portion of the retention means forwardly formed a recess thereon. The handle is position by one side of the socket and can be retained by the recess in a right position with regard to the base.

Other objects, advantages and novel features of the invention will become more apparent from the following detailed description of the present embodiment when taken in conjunction with the accompanying drawings.

DETAILED DESCRIPTION OF THE INVENTION

Figure 1:
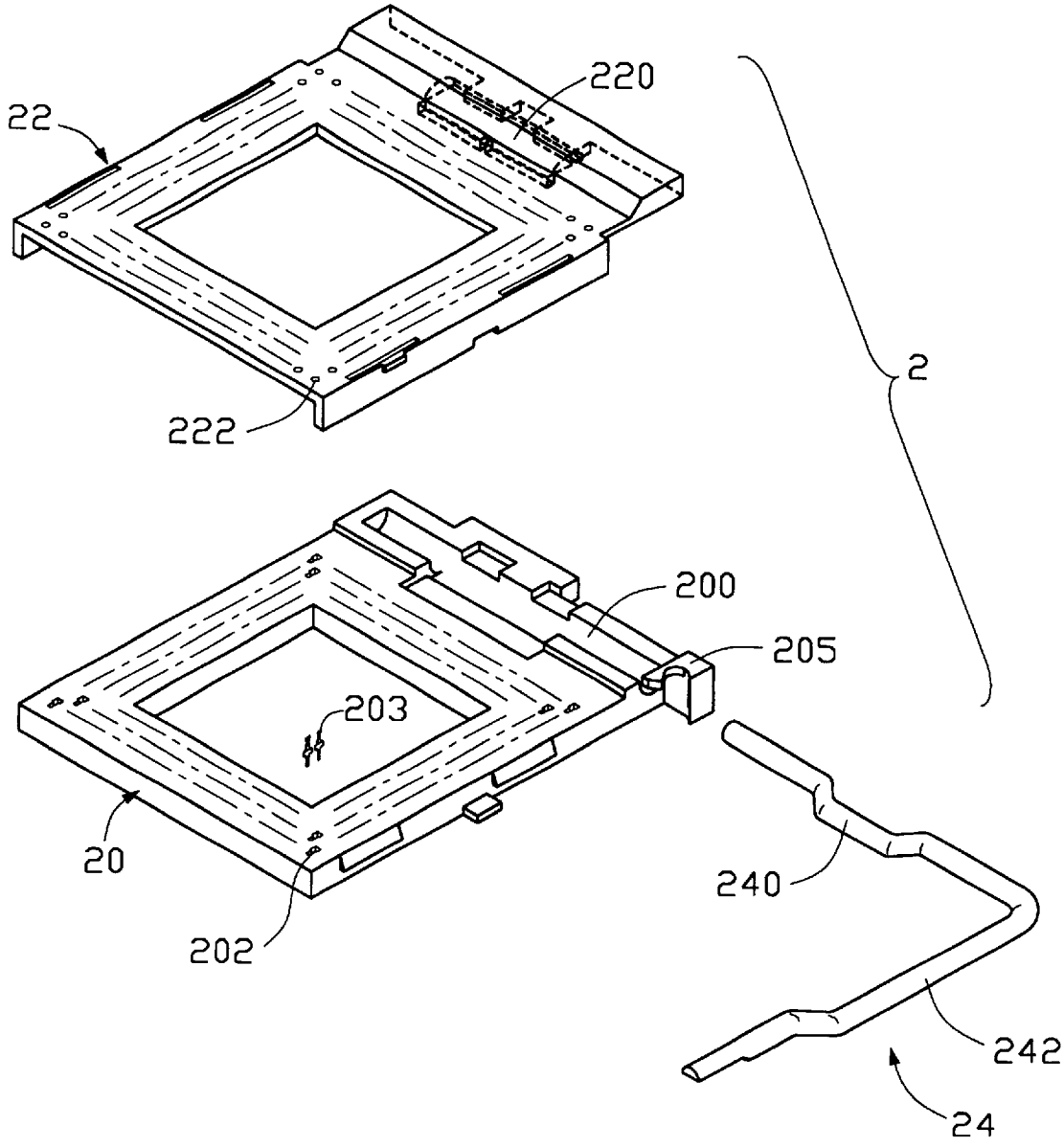
FIG. 1 is an exploded view of a ZIF socket in accordance with the present invention.

Referring to FIG. 1, a ZIF socket 2 having retention means comprise a base 20, a cover 22 and a lever 24. The base 20 has a plurality of passageways 202 extending vertically therethrough for receiving a corresponding number of contacts 203 therein and a bottom half channel 200. The cover 22 has the similar contour with the base 20, including a plurality of holes 222 extending vertically therethrough in alignment with the corresponding passageways 202, respectively, so that the pins which extend downward from the CPU component (not shown) may project downward through the corresponding holes 222 in the cover 22 and further into the corresponding passageways 202 in the base 20 for mechanically and electrically engagement with the corresponding contacts 203 therein. The cover 22 further includes an upper half channel 220 wherein the bottom channel 200 joins with the upper channel 220 to form a full channel (not labeled) enclosing a cam shaft 240 of a lever 24 of the socket 2. The lever 24 further includes a handle 242 exposed by one side of the socket 2.

Figure 2:
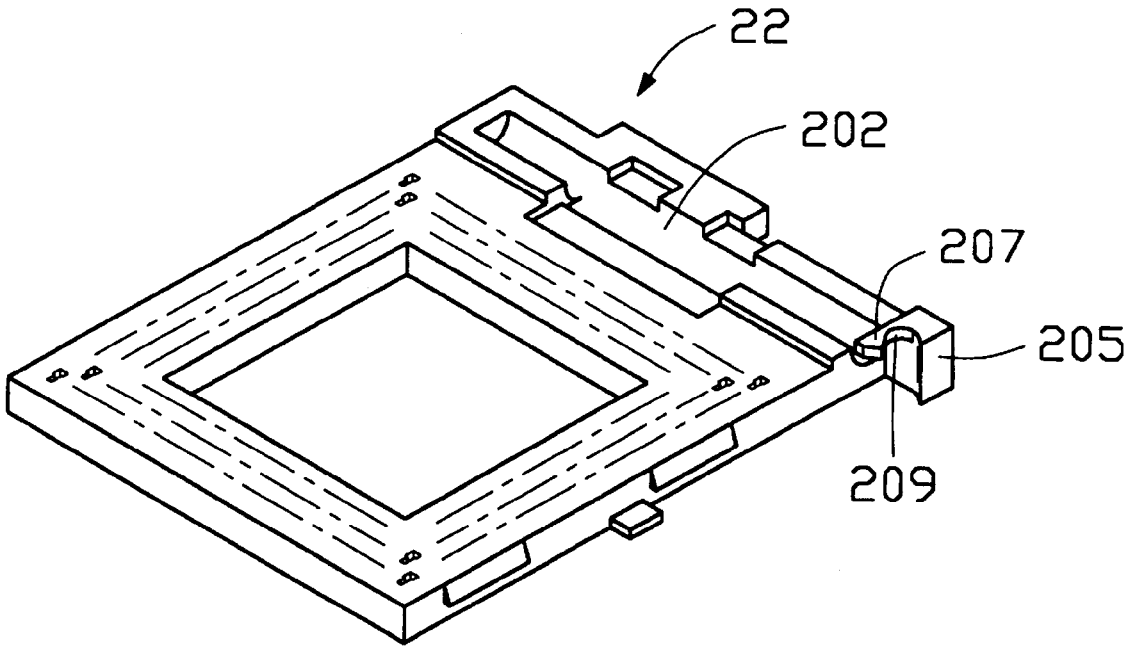
FIG. 2 is a perspective view of a base of the socket in accordance with the present invention.

Referring to FIG. 2, the base 20 further includes a retention means 205 integrally formed by one side of a rear portion of the base 20. A resilient arm 207 extending from a top portion of the retention means 205 forwardly defines a recess 209 corresponding with the bottom channel 202.

Figure 3:
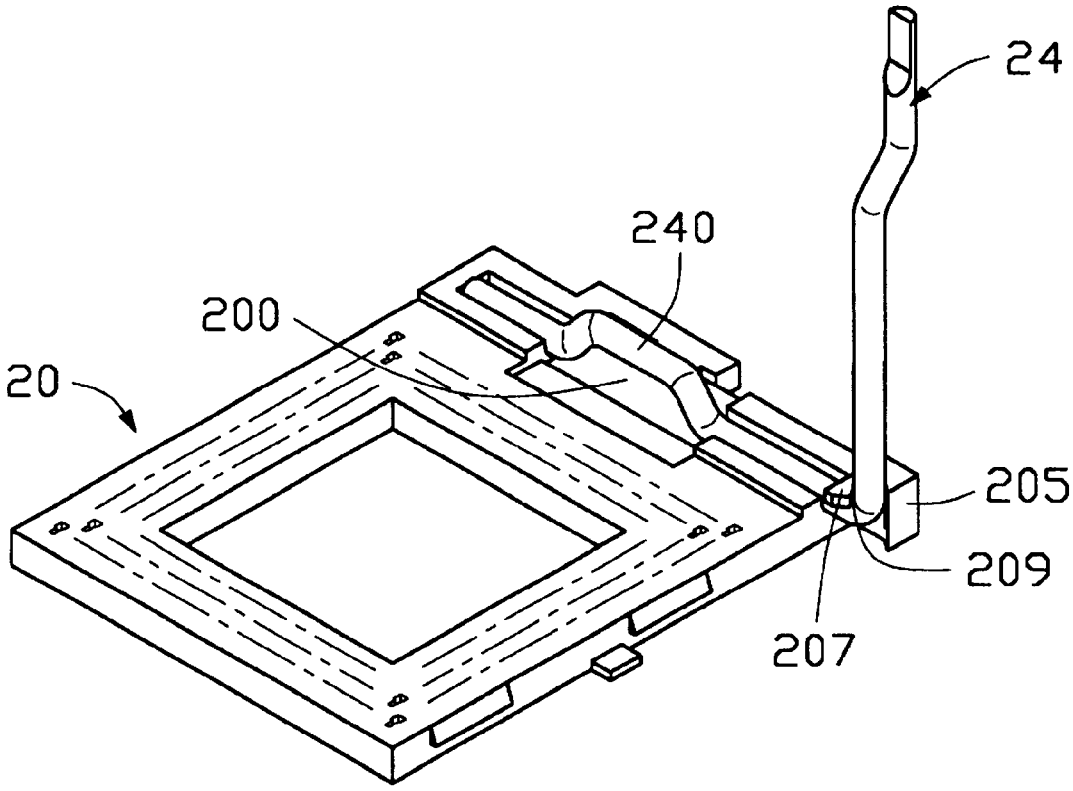
FIG. 3 is a perspective view of the base and a lever of the socket in accordance with the present invention.
Figure 4:
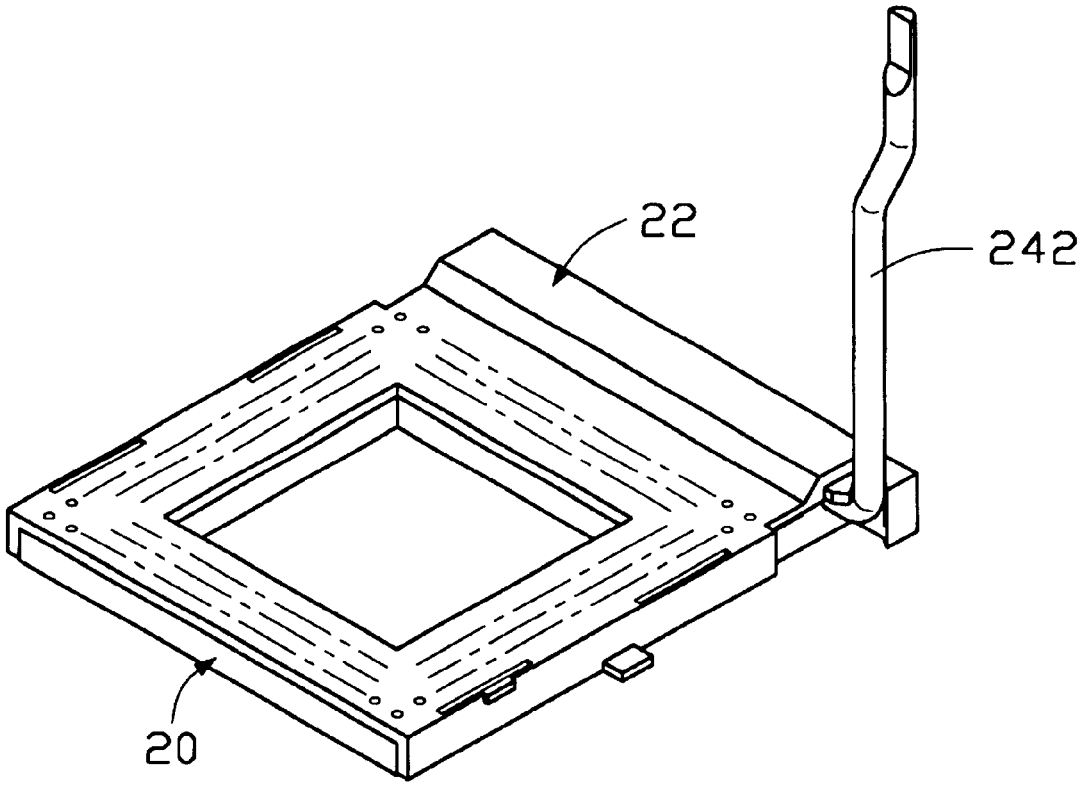
FIGS. 4 is an assembled perspective view of the socket in accordance with the present invention.
Figure 5:
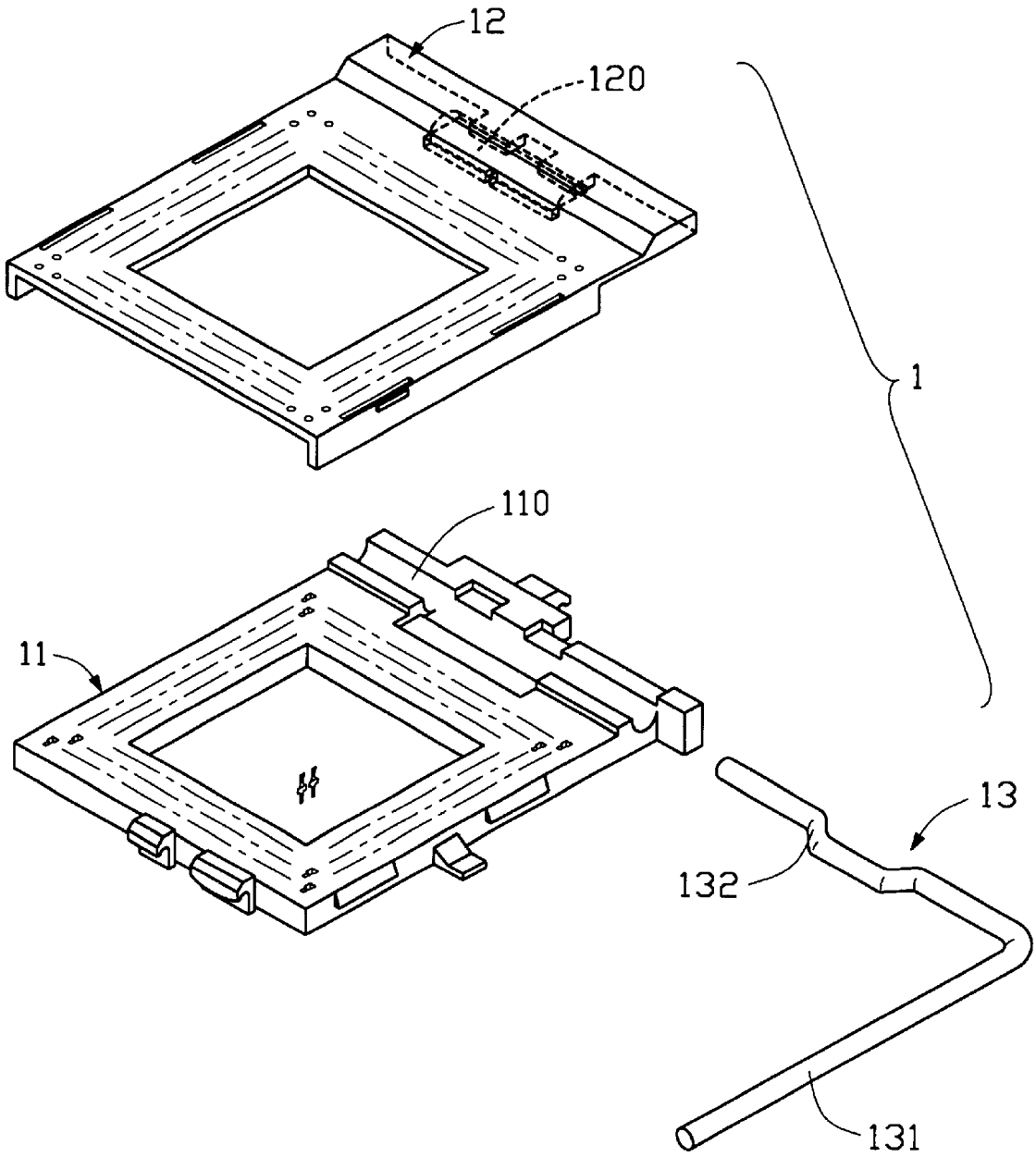
FIG. 5 (PRIOR ART)
FIG. 5 is an exploded view of a prior art ZIF socket.

Referring to FIG. 3, in assembly, the cam shaft 240 of the lever 24 is received in the bottom channel 200, and the handle 242 is in a vertical position with the bottom portion thereof hold in the recess 209 of the resilient arm 207 of the retention means 205. At the moment, the cam shaft 242 of the lever 24 is extending upwardly to facilitate enclosing of the bottom channel 200 and the upper channel 220. Referring to FIGS. 1 and 4, the cover 22 and the base 20 are joined together when the handle 242 is in a vertical position with regard to the base 20. The cam shaft 242 extends into the upper channel 220 exactly and the holes 222 of the cover 22 is in a true position corresponding with the passageways 202 of the base 20 to facilitate the pins of the CPU inserting into the socket 2 in a ZIF status.

By this arrangement, when the handle 240 of the lever 24 is turned from a vertical position to a horizontal position, the cam shaft 242 will drive the cover 22 sliding regard to the base 20 and the pins will mechanically and electrically engage with the contacts 204 received in the passageways 202 of the base 20. Furthermore, when the handle 240 is turned from the horizontal position to the vertical position, the cam shaft 242 will drive the pins from contacting with the contact 204, the handle 240 is retained in the recess 209 of resilient arm 207 of the retention means 205. The CPU is easy to pull out of the socket 2 and is unlike to damage the pins thereof.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A ZIF socket comprising:

a base having a plurality of passageways extending therethrough;

a corresponding number of contacts received within the passageways respectively;

a cover slidably mounted to the base and defining a number of holes extending through the cover in alignment with corresponding passageways;

a lever including a handle and a cam shaft joined with each other at an angle, the handle being exposed to one side of the base, the cam shaft being positioned between the base and the cover; and a retention means positioned on a rear portion of the base and beside the handle of the lever, the retention means including a recess retaining the lever at a fixed position; wherein the retention means comprises a horizontal forwardly-extending resilient arm and the recess is defined on the resilient arm.

2. The ZIF socket as claimed in claim 1, wherein the fixed position is a vertical position with regard to the base.

3. The ZIF socket as claimed in claim 1, wherein the retention means is integrally formed on the rear portion of the base.

4. A ZIF socket comprising:

a base;

a cover slidably mounted onto the base along a front-to-back direction;

a lever including a handle and a cam shaft joined with each other, said cam shaft extending in a lateral direction perpendicular to said front-to-back direction and adapted to actuate the cover to move along said front-to-back direction, said handle moveable along a vertical plane perpendicular to said lateral direction; and a resilient retention device positioned on the base around a joint section of said handle and said cam shaft, said retention device being configured to be able to retain the handle in a vertical position without improperly laterally pushing the cover during rotation of said handle to said vertical position.

5. The socket as claimed in claim 4, wherein said retention device extends in said front-to-back direction.

6. The socket as claimed in claim 5, wherein said cover defines a recess around the retention device of said base so as to allow retention device to be inwardly laterally deflected during rotation of the handle without interference therebetween.

7. The socket as claimed in claim 4, wherein said retention device is positioned between the handle and the cover when said handle is in the vertical position.

8. The socket as claimed in claim 4, wherein said retention device is integrally formed with the base.

9. A ZIF socket comprising:

a base;

a cover slidably mounted onto the base along a front-to-back direction;

a lever including a handle and a cam shaft joined with each other, said cam shaft extending in a lateral direction perpendicular to said front-to-back direction and adapted to actuate the cover to move along said front-to-back direction, said handle moveable along a vertical plane perpendicular to said lateral direction; and a resilient retention device positioned on the base and configured to be able to retain the handle in a vertical position; wherein said retention device is positioned between the cover and the handle when said handle is in said vertical position.

10. The socket as claimed in claim 9, wherein said retention device defines an indent configured to comply with a periphery of said handle.

11. The socket as claimed in claim 10, wherein said indent faces outwardly.

* * * * *